US007946043B2

(12) United States Patent
Taboada et al.

(10) Patent No.: US 7,946,043 B2
(45) Date of Patent: May 24, 2011

(54) ARCHERY BOW PLANE ALIGNMENT DEVICE AND METHOD

(76) Inventors: John Martin Taboada, San Antonio, TX (US); Stuart Minica, La Vernia, TX (US)

( * ) Notice: Subject to any disclaimer, the term of this patent is extended or adjusted under 35 U.S.C. 154(b) by 0 days.

(21) Appl. No.: 12/331,683

(22) Filed: Dec. 10, 2008

(65) Prior Publication Data

US 2009/0144994 A1 Jun. 11, 2009

Related U.S. Application Data

(60) Provisional application No. 61/007,163, filed on Dec. 11, 2007.

(51) Int. Cl.
*F41G 1/00* (2006.01)
*F41B 5/00* (2006.01)

(52) U.S. Cl. ..... 33/265; 33/286; 33/DIG. 21; 33/506; 124/87; 124/90

(58) Field of Classification Search ..... 33/265, 33/506, 281, 282, 285, 286, DIG. 21, 1 LE; 124/86–88, 90, 91
See application file for complete search history.

(56) References Cited

U.S. PATENT DOCUMENTS

| | | | | |
|---|---|---|---|---|
| 4,594,786 | A * | 6/1986 | Rezmer | 33/506 |
| 4,911,137 | A | 3/1990 | Troncoso | |
| 4,974,576 | A * | 12/1990 | Morey et al. | 124/91 |
| 5,898,809 | A * | 4/1999 | Taboada et al. | 385/115 |
| 5,983,879 | A * | 11/1999 | Gifford | 124/1 |
| 6,526,666 | B1 | 3/2003 | Lastinger | |
| 6,763,598 | B1 * | 7/2004 | Chen | 33/286 |
| 6,851,197 | B2 | 2/2005 | Terry | |
| 7,353,611 | B2 * | 4/2008 | Edwards et al. | 33/265 |
| 7,401,411 | B2 * | 7/2008 | White | 33/265 |
| 7,409,770 | B2 * | 8/2008 | Jones | 33/265 |
| 2008/0134526 | A1 * | 6/2008 | Christensen | 33/265 |
| 2009/0032004 | A1 * | 2/2009 | Jones | 124/86 |
| 2009/0071022 | A1 * | 3/2009 | Stagg | 33/265 |

* cited by examiner

*Primary Examiner* — Amy Cohen Johnson

(74) *Attorney, Agent, or Firm* — John M. Taboada

(57) ABSTRACT

Methods and systems for tuning an archery bow are disclosed, including providing a bow having a string, providing a laser plane, rotating the laser plane to be inline with the string and aligning the bow to the laser plane.

7 Claims, 4 Drawing Sheets

ARCHERY BOW PLANE ALIGNMENT DEVICE AND METHOD

The inventors claim priority to provisional patent application No. 61/007,163 filed on Dec. 11, 2007.

I. BACKGROUND

The invention relates generally to the field of archery bow alignment devices.

II. SUMMARY

In one respect, disclosed is a method for tuning an archery bow, the method comprising: providing a bow having a string, providing a laser plane, rotating the laser plane to be inline with the string and aligning the bow to the laser plane.

In another respect, disclosed is a bow alignment device comprising: a housing; the housing comprising a power source, a laser, and a lens; where the lens scatters the laser beam into a plane of laser light.

Numerous additional embodiments are also possible.

III. BRIEF DESCRIPTION OF THE DRAWINGS

Other objects and advantages of the invention may become apparent upon reading the detailed description and upon reference to the accompanying drawings.

Figure 1:
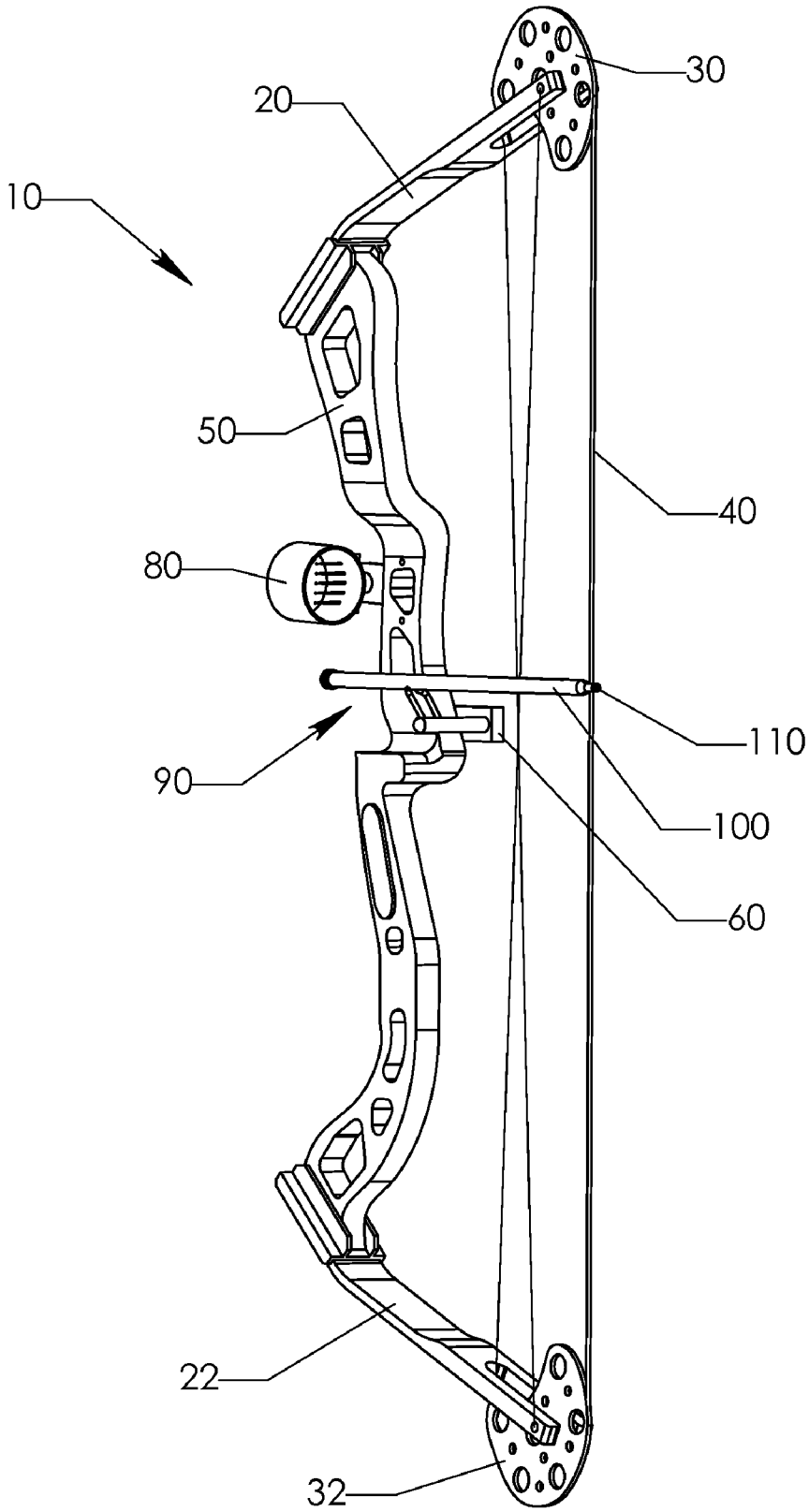
FIG. 1 is a side perspective view of an archery bow including the laser plane alignment device of the present invention, in accordance with some embodiments. The laser plane alignment device is shown with the laser not activated.

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

IV. DETAILED DESCRIPTION

One or more embodiments of the invention are described below. It should be noted that these and any other embodiments are exemplary and are intended to be illustrative of the invention rather than limiting. While the invention is widely applicable to different types of systems, it is impossible to include all of the possible embodiments and contexts of the invention in this disclosure. Upon reading this disclosure, many alternative embodiments of the present invention will be apparent to persons of ordinary skill in the art.

This invention relates to the field of archery and the problem of setting up and aligning an archery bow and its attachments, and more specifically to an archery alignment device and method that accomplishes a faster, more convenient and more precise alignment by use of a plane of laser light or portion thereof.

FIG. 1 is a side perspective view of an archery bow including the laser plane alignment device of the present invention, in accordance with some embodiments. The laser plane alignment device is shown with the laser not activated.

In some embodiments, the archery bow 10 includes a riser 50, an upper flexible limb 20, a lower flexible limb 22, an upper wheel or cam 30, a lower wheel or cam 32, at least one string 40 and a sight 80. An arrow rest 60 is connected to the riser 50 to support a typical arrow (not shown) or in this preferred embodiment, the laser plane alignment device 90 of the present invention. The laser alignment device 90 has a device housing 100 much like an arrow shaft and an adapter 110 much like an arrow nock. The device housing 100 sits on the arrow rest 60 and connects to the bowstring 40 with the adapter 110 like a typical arrow.

Figure 2:
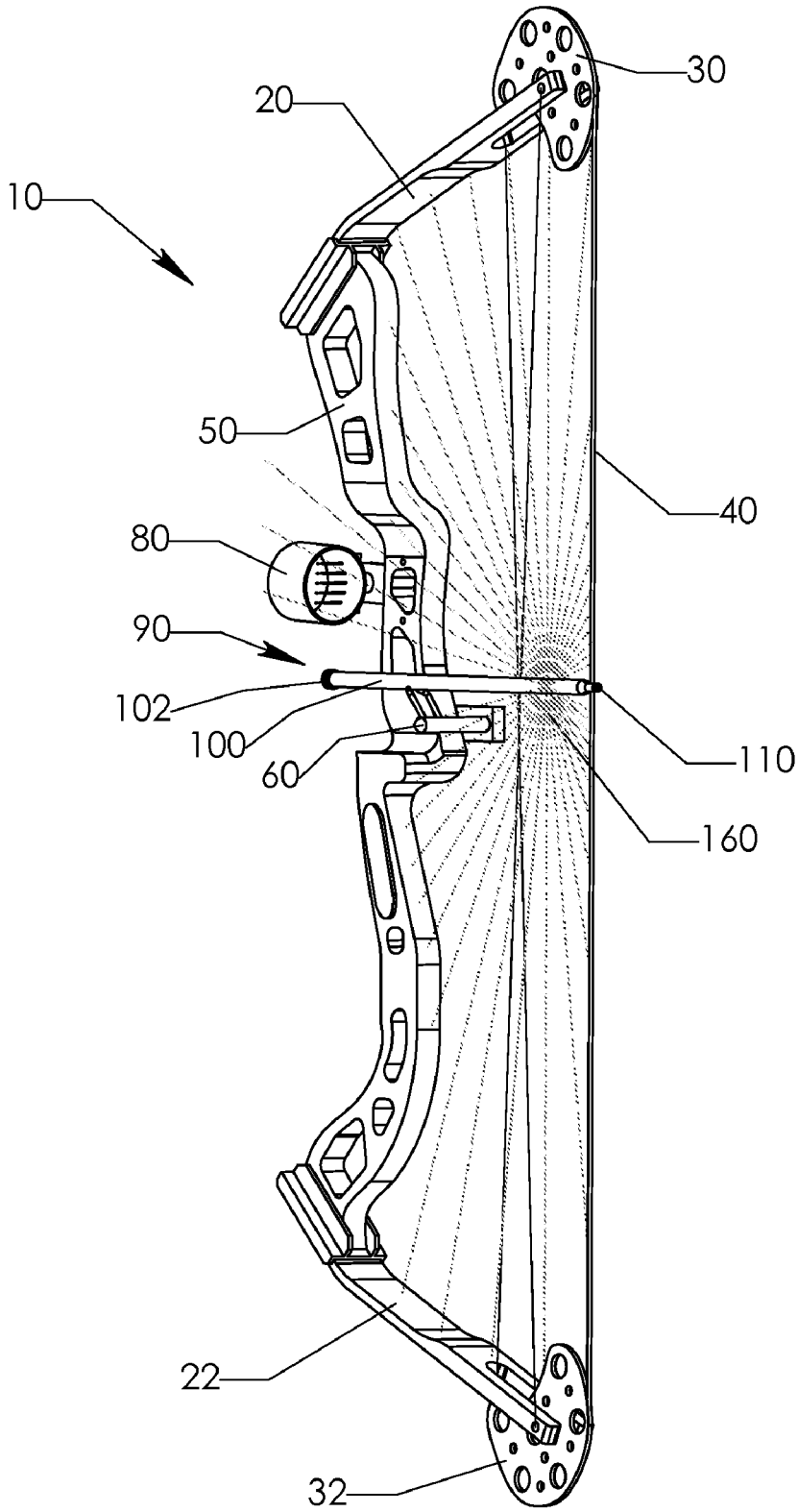
FIG. 2 is a side perspective view of an archery bow including the laser plane alignment device of the present invention, in accordance with some embodiments. The laser plane alignment device is shown with the laser activated.

FIG. 2 is a side perspective view of an archery bow including the laser plane alignment device of the present invention, in accordance with some embodiments. The laser plane alignment device is shown with the laser activated.

In some embodiments, the archery bow 10 includes a riser 50, an upper flexible limb 20, a lower flexible limb 22, an upper wheel or cam 30, a lower wheel or cam 32, at least one string 40 and a sight 80. An arrow rest 60 is connected to the riser 50 to support a typical arrow (not shown) or in this preferred embodiment, the laser plane alignment device 90 of the present invention. The laser alignment device 90 has a device housing 100 much like an arrow shaft and an adapter 110 much like an arrow nock. The device housing 100 sits on the arrow rest 60 and connects to the bowstring 40 with the adapter 110 like a typical arrow. When the laser alignment device 90 is activated, a sheet of laser light 160 is projected within the archery bow 10.

Figure 3:
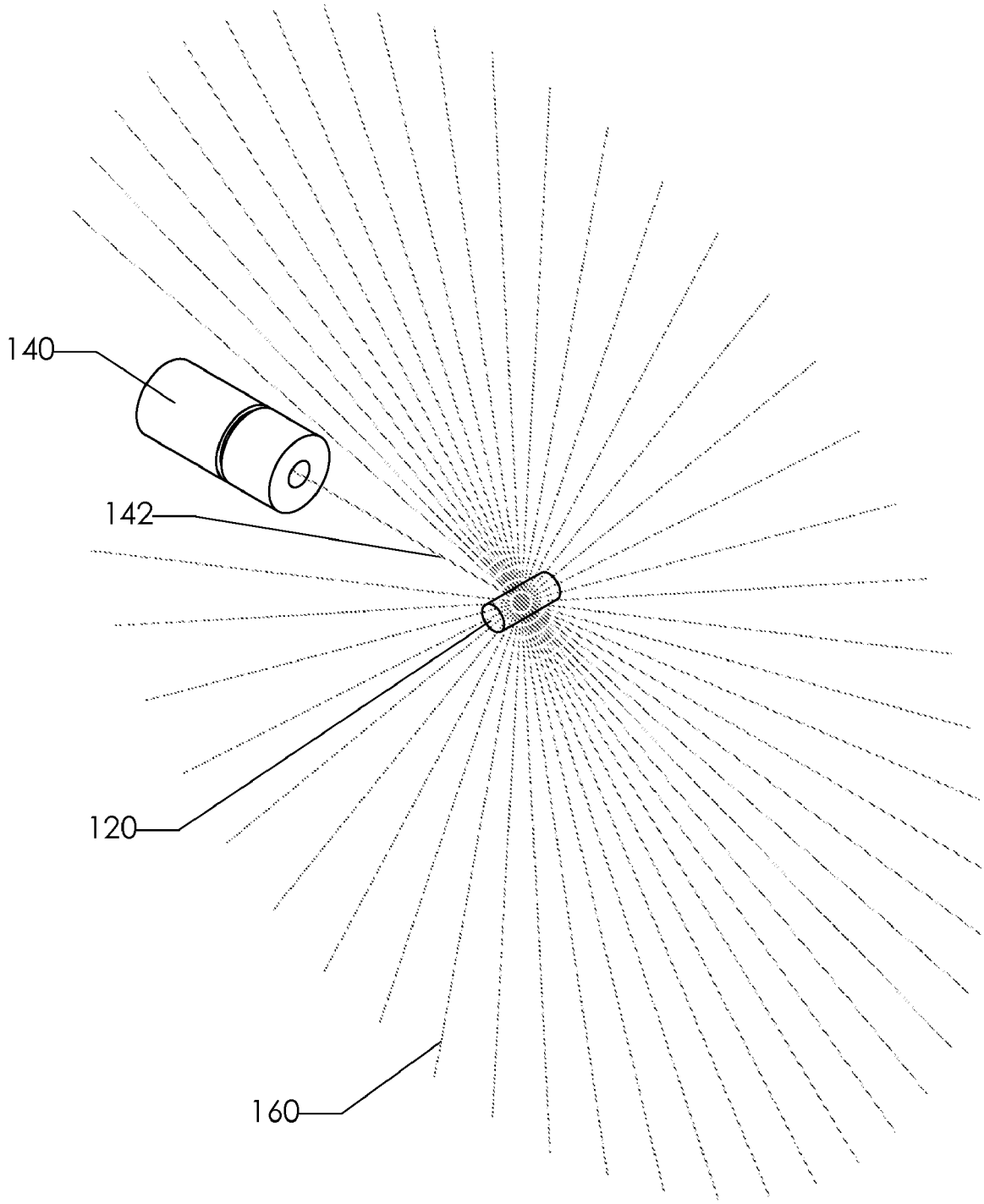
FIG. 3 is a side perspective view of a laser plane or portion thereof being generated with a fiber optic bundle and a laser beam source, in accordance with some embodiments.

FIG. 3 is a side perspective view of a laser plane or portion thereof being generated with a fiber optic bundle and a laser beam source, in accordance with some embodiments.

In some embodiments, the laser plane 160 or portion thereof is generated from the laser beam source 140 striking the fiber optic bundle 120. The laser beam source 140 projects a laser beam 142 substantially orthogonal to the lens or fiber optic bundle 120, which generates a laser plane 160. This technology is taught by U.S. Pat. No. 5,898,809 issued Apr. 27, 1999 to John Taboada and John Martin Taboada. Further examples of devices and methods to generate a laser plane or portion thereof from a laser beam source can be found in the Taboada et. al. patent.

Figure 4:
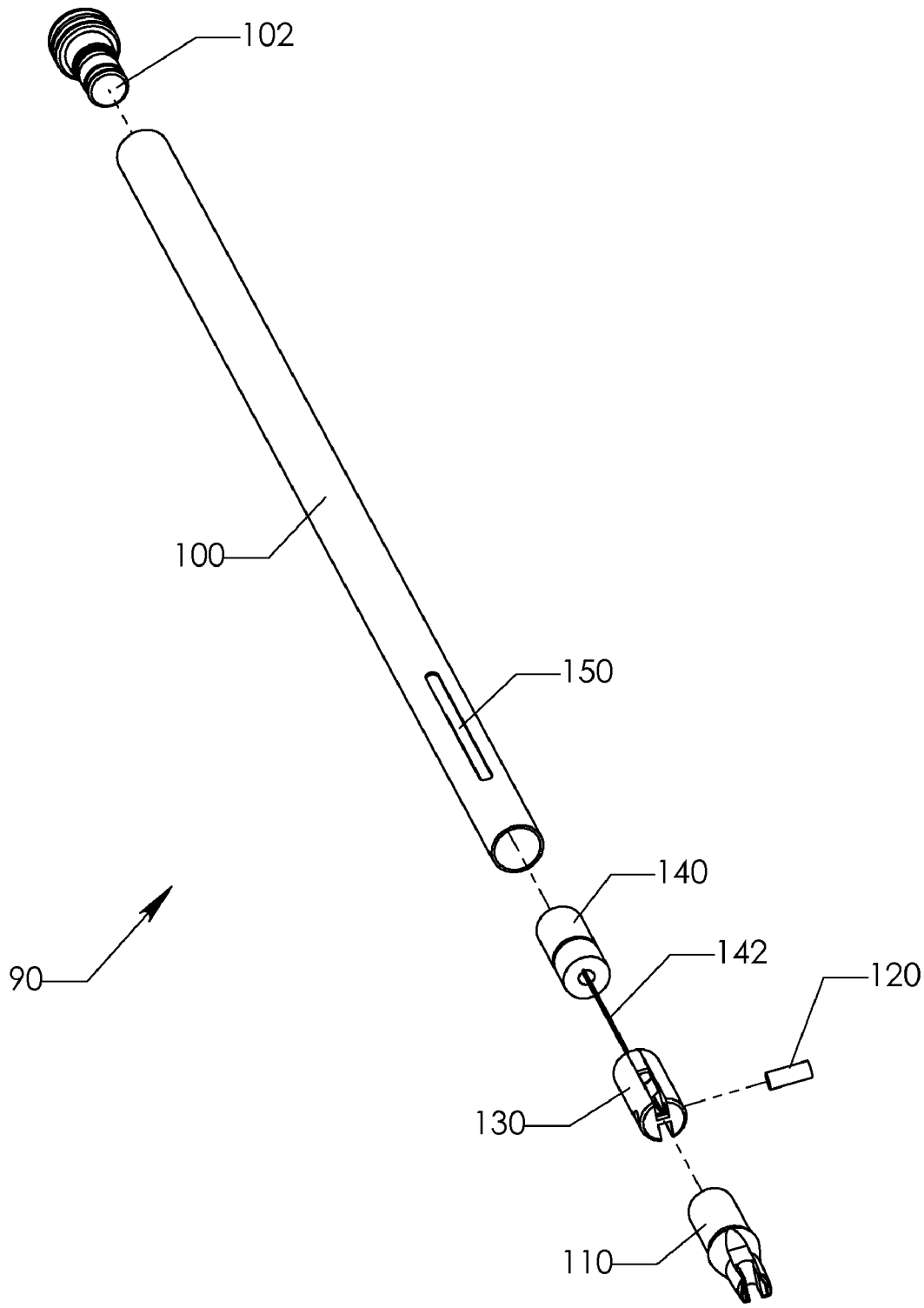
FIG. 4 is an exploded side perspective view of the laser plane alignment device of FIG. 1 and FIG. 2, in accordance with some embodiments.

FIG. 4 is an exploded side perspective view of the laser plane alignment device of FIG. 1 and FIG. 2, in accordance with some embodiments.

In some embodiments, the fiber optic bundle 120 is connected to and positioned by a housing 130 wherein the laser beam source 140 projects a laser beam 142 substantially orthogonal onto the fiber optic bundle 120. The laser beam source 140 and the fiber optic bundle 120 are connected interiorly to the device housing 100 by the fiber optic housing 130 whereby the laser plane 160 is allowed to exit through a slot 150 for alignment of the archery bow. A switch 102 activates and deactivates the laser plane 160 by connecting a power source such as at least one battery (not shown) to the laser beam source 140.

In some embodiments, referring back to FIG. 2, the method for using the laser plane alignment device 90 on the archery bow 10 is to first install the laser plane alignment device 90 onto the archery bow 10 by placing the nock 110 onto the bowstring 40 and sitting the device housing 100 on the arrow rest 60, like how a typical arrow sits on a bow. The laser beam source 140 shown in FIG. 3 and FIG. 4 is then activated by the switch 102 producing the laser plane 160. The laser plane 160 is aligned with the bowstring 40 by rotating the device housing 100 about the long axis of the adapter 110 until the laser plane 160 is inline with the bowstring 40. While the laser plane 160 is still activated and aligned with the bowstring 40, the arrow rest 60 is adjusted left or right while the laser plane alignment device 90 is still sitting on the rest, until the laser plane 160 is aligned with the wheel or cam 30. When moving the arrow rest 60 left or right with the laser plane alignment device 90 sitting on the arrow rest 60, the laser plane 160 does not translate left or right but rotates about the long axis of the bowstring 40 while maintaining alignment of the laser plane 160 with the bowstring 40. With the laser plane 160 aligned to the bowstring 40 and the upper wheel or cam 30, now the sight 80, the upper flexible limb 20, the lower flexible limb 22, the lower wheel or cam 32 and the rest 60 or any other bow accessory can be aligned to the same laser plane 160.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

The invention claimed is:

1. A method for tuning a bow comprising:

providing a bow comprising a string, an arrow rest, and a wheel or cam;

providing a bow alignment device comprising a housing comprising a slot through a wall of the housing;

a power source disposed within the housing;

a laser disposed within the housing and electrically connected to the power source;

a lens disposed within the housing and configured to project a substantially planar sheet of laser light through the slot; and an adapter coupled to the housing and configured to rotatably connect the housing to the string;

connecting the adapter of the bow alignment device to the string;

sitting the bow alignment device on the arrow rest;

rotating the housing of the bow alignment device until the substantially planar sheet of laser light projects onto the string; and adjusting the arrow rest until the substantially planar sheet of laser light projects onto the wheel or cam.

2. The method of claim 1 where only a portion of the substantially planar sheet of laser light is generated.

3. The method of claim 1, the method further comprising:

providing a bow further comprising an upper flexible limb, a lower flexible limb; a second wheel or cam; and aligning the bow to the substantially planar sheet of laser light, wherein aligning the bow to the substantially planar sheet of laser light comprises at least one of: aligning the upper flexible limb, aligning the lower flexible limb, aligning the second wheel or cam, and aligning any other bow accessory.

4. A bow alignment device comprising:

a housing configured to sit on an arrow rest of an archery bow and comprising a slot through a wall of the housing;

a power source disposed within the housing;

a laser disposed within the housing and electrically connected to the power source;

a lens disposed within the housing and configured to project a substantially planar sheet of laser light through the slot; and an adapter coupled to the housing and configured to rotatably connect the housing to a string of the archery bow until the substantially planar sheet of laser light projects onto the string of the archery bow.

5. The bow alignment device of claim 4, where the lens consists of a fiber optic bundle.

6. The bow alignment device of claim 4, where the lens consists of a cylindrical lens.

7. The bow alignment device of claim 4, where only a portion of the substantially planar sheet of laser light is generated.

* * * * *